US011108195B2

(12) United States Patent
Hashimoto et al.

(10) Patent No.: US 11,108,195 B2
(45) Date of Patent: Aug. 31, 2021

(54) SHIELD TERMINAL AND SHIELD CONNECTOR

(71) Applicant: Sumitomo Wiring Systems, Ltd., Yokkaichi (JP)

(72) Inventors: Norihito Hashimoto, Yokkaichi (JP); Shohei Mitsui, Yokkaichi (JP); Liping Kang, Yokkaichi (JP); Motoki Kubota, Yokkaichi (JP); Masanobu Kasuga, Yokkaichi (JP); Wataru Yamanaka, Yokkaichi (JP); Keisuke Kanemura, Yokkaichi (JP); Ai Hirano, Yokkaichi (JP); Shinobu Wakahara, Toyota (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/792,926

(22) Filed: Feb. 18, 2020

(65) Prior Publication Data

US 2020/0274299 A1 Aug. 27, 2020

(30) Foreign Application Priority Data

Feb. 27, 2019 (JP) ..... JP2019-033561

(51) Int. Cl.
*H01R 13/6593* (2011.01)
*H01R 13/6582* (2011.01)
(Continued)

(52) U.S. Cl.
CPC ..... *H01R 13/6582* (2013.01); *H01R 13/10* (2013.01); *H01R 13/502* (2013.01); *H01R 13/6587* (2013.01); *H01R 13/6593* (2013.01)

(58) Field of Classification Search
CPC ..... H01R 9/032; H01R 9/034; H01R 9/035; H01R 9/037; H01R 9/038; H01R 9/0512;
(Continued)

(56) References Cited

U.S. PATENT DOCUMENTS 5,934,940 A * 8/1999 Maranto ..... H01R 13/74 439/607.25
5,961,350 A * 10/1999 Shiu ..... H01R 12/7017 439/607.01
(Continued)

FOREIGN PATENT DOCUMENTS

JP 2008-192474 8/2008

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A shield terminal (20) includes an inner conductor terminal (21) and an outer conductor terminal (22) surrounding the inner conductor terminal (21). The outer conductor terminal (21) has a pull-out opening (46) through which an inner conductor connecting piece (26) of the inner conductor terminal (21) is pulled toward a circuit board (90). The outer conductor terminal (22) includes outer conductor connecting pieces that face the pull-out opening (46) and that include first and second outer conductor connecting pieces (53, 54) located on both sides across the inner conductor connecting piece (26) in a plan view and a third outer conductor connecting piece (42) that faces the inner conductor connecting piece (26) in a direction orthogonal to an arrangement direction of the first and second outer conductor connecting pieces (53, 54) at a position between the first and second outer conductor connecting pieces (53, 54) in the arrangement direction.

15 Claims, 8 Drawing Sheets

(51) Int. Cl.
*H01R 13/502* (2006.01)
*H01R 13/6587* (2011.01)
*H01R 13/10* (2006.01)

(58) Field of Classification Search
CPC .. H01R 9/0515; H01R 9/0707; H01R 9/0778; H01R 9/0785; H01R 12/594; H01R 12/596; H01R 12/598; H01R 12/775; H01R 13/652; H01R 13/655; H01R 13/6581; H01R 13/6591–6595; H01R 13/56–72; H01R 23/662; H01R 24/22; H01R 24/30; H01R 24/70; H01R 24/78; H01R 33/7664
See application file for complete search history.

(56) References Cited

U.S. PATENT DOCUMENTS

| | | | | |
|---|---|---|---|---|
| 6,113,426 | A * | 9/2000 | Lin | H01R 12/725 439/607.43 |
| 10,566,741 | B2 * | 2/2020 | Maesoba | H01R 13/648 |
| 2013/0059472 | A1 * | 3/2013 | Saito | H01R 13/648 439/607.27 |

* cited by examiner

SHIELD TERMINAL AND SHIELD CONNECTOR

BACKGROUND

Field of the Invention

The invention relates to a shield terminal and a shield connector.

Related Art

Japanese Unexamined Patent Publication No. 2008-192474 discloses a shield terminal including an inner conductor terminal, an outer conductor terminal surrounding the inner conductor terminal and a dielectric interposed between the outer conductor terminal and the inner conductor terminal. The shield terminal is accommodated into a connector housing. The inner conductor terminal is a tab-like structure bent into an L shape and includes a board mounting tab extending in a vertical direction. The board mounting tab of the inner conductor terminal is inserted into a through hole of a circuit board. The outer conductor terminal is composed of an outer conductor terminal body covering the inner conductor terminal and a lid body for closing an opening on a back surface of the outer conductor terminal body. The outer conductor terminal body includes board mounting tabs projecting down from four corners of a pull-out opening through which the board mounting tab of the inner conductor terminal is pulled out. The respective board mounting tabs of the outer conductor terminal are inserted into through holes of the circuit board.

The outer conductor terminal body and the lid body cover and shield the board mounting tab of the inner conductor terminal. However, to reduce material cost and to improve yield, a shielding property of the inner conductor terminal may be ensured by removing a front wall that covers a front end of the board mounting tab of the inner conductor terminal and arranging the respective board mounting tabs of the outer conductor terminal around the board mounting tab of the inner conductor terminal. In the above case, the board mounting tabs of the outer conductor terminal are arranged on the four corners of the pull-out opening and are at positions separated from the board mounting tab of the inner conductor terminal. Thus, the shielding property of the inner conductor terminal may not be sufficient.

The present invention was completed on the basis of the above situation and aims to provide a shield terminal and a shield connector capable of improving a shielding property.

SUMMARY

The invention is directed to a shield terminal with an inner conductor terminal including an inner conductor connecting piece to be connected to a conductive portion of a circuit board, and an outer conductor terminal including outer conductor connecting pieces to be connected to a ground of the circuit board. The outer conductor terminal surrounds the inner conductor terminal and has a pull-out opening through which the inner conductor connecting piece is pulled out toward the circuit board. The outer conductor connecting pieces are arranged to face the pull-out opening and include first and second outer conductor connecting pieces located on both sides across the inner conductor connecting piece in a plan view and a third outer conductor connecting piece located to face the inner conductor connecting piece in a direction orthogonal to an arrangement direction of the first and second outer conductor connecting pieces at a position between the first and second outer conductor connecting pieces in the arrangement direction. Thus, as compared to the case where the board mounting tabs of the outer conductor terminal are located diagonally to the four corners of the pull-out opening as in Japanese Unexamined Patent Publication No. 2008-192474, the first to third outer conductor connecting pieces can be located near the inner conductor connecting piece and effectively shield the inner conductor terminal.

The pull-out opening may be formed by bending the third outer conductor connecting piece toward the circuit board, and the third outer conductor connecting piece may be arranged with a plate surface outside bend facing the inner conductor connecting piece. According to this configuration, the third outer conductor connecting piece is formed together with the pull-out opening in a high yield by bending after the stamping of a metal plate. Further, the inner conductor connecting piece is shielded satisfactorily by causing the plate surface of the third outer conductor connecting piece to face the inner conductor connecting piece.

The third outer conductor connecting piece may project from a central region excluding outer end parts of the outer conductor terminal and may be mounted through a connection hole of the circuit board. According to this configuration, stress transmitted to the outer conductor terminal in a heating environment can escape to the circuit board via the third outer conductor connecting piece projecting from the central region of the outer conductor terminal. Thus, a position of the outer conductor terminal will not deviate with respect to the circuit board.

A shield connector may include the above-described shield terminal with a dielectric between the inner conductor terminal and the outer conductor terminal. The shield connector also may include a connector housing for accommodating the shield terminal. The shield achieves a good shielding property, and the shield connector can be used suitably, for example, as a shield connector for high-speed communication of an automotive vehicle.

The connector housing may include a recess recessed in a direction retracted from a position where the third outer conductor connecting piece is connected to the ground portion of the circuit board. According to this configuration, it is possible to avoid contact of the connector housing with solder paste applied at the position where the third outer conductor connecting piece is connected to the ground portion of the circuit board and to improve mounting reliability on the circuit board. Further, the recess makes the connector housing less likely to deform and helps to ensure coplanarity with the circuit board.

DETAILED DESCRIPTION

An embodiment of the invention is described with reference to FIGS. 1 to 8. A shield connector 10 of this embodiment is installed in an unillustrated automotive vehicle and is used in high-speed communication between in-vehicle electrical components. Note that, in the following description, a left side of FIG. 4 is referred to as a front concerning a front-rear direction and upper and lower sides are based on a vertical direction of FIGS. 1 and 4.

Figure 1:
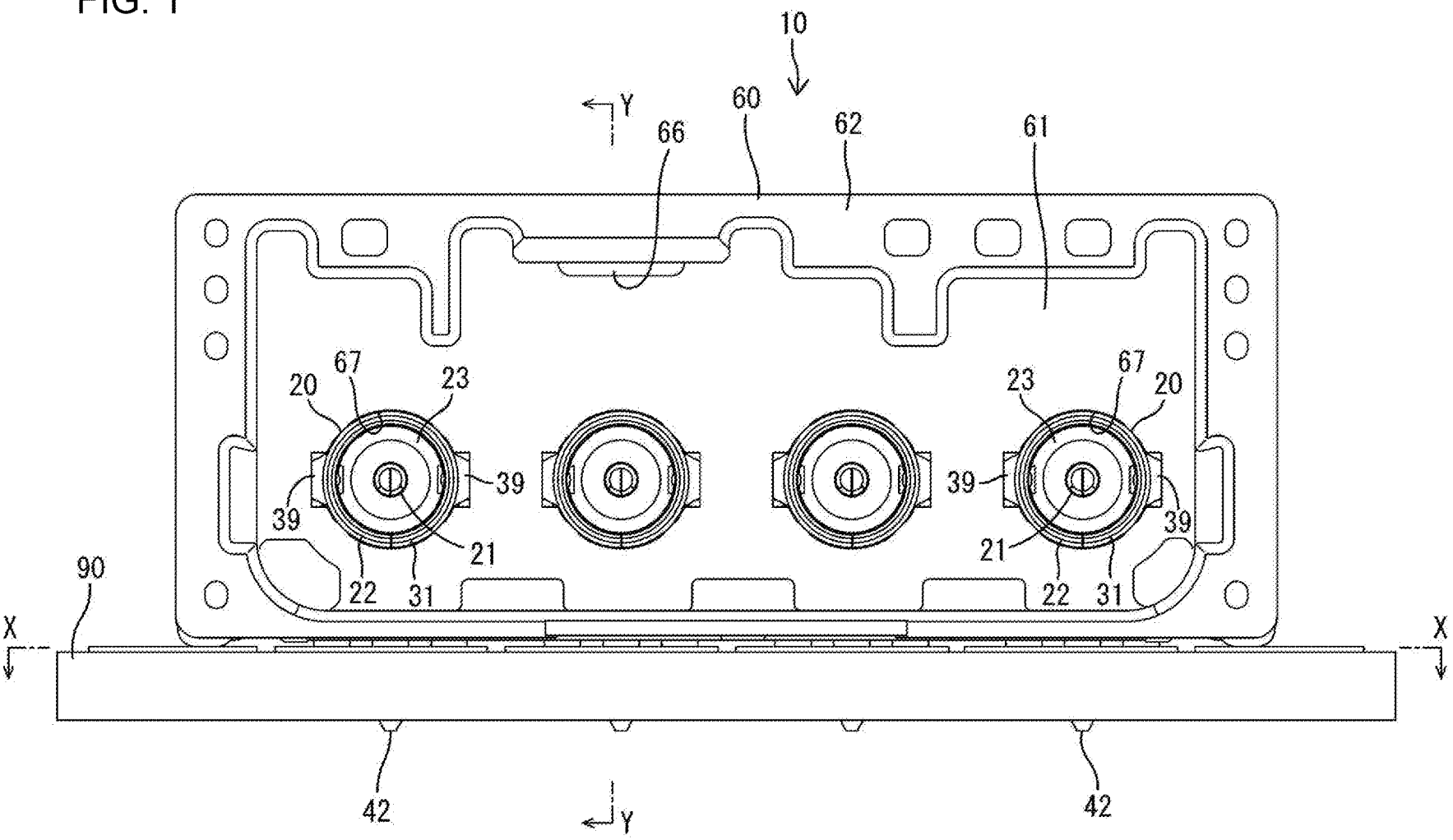
FIG. 1 is a front view of a shield connector of one embodiment of the present invention.
Figure 4:
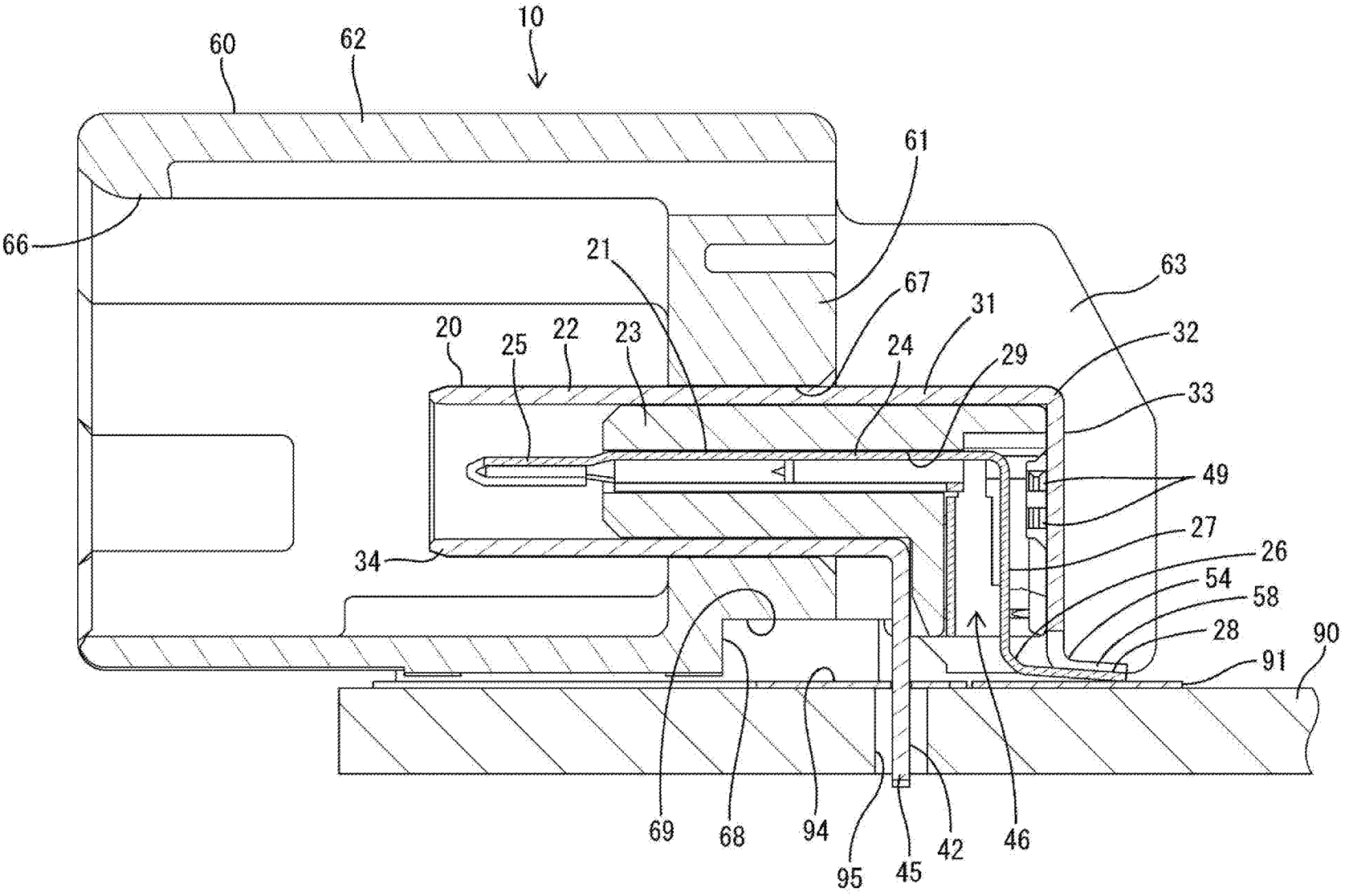
FIG. 4 is a section along Y-Y of FIG. 1.

As shown in FIGS. 1 and 4, the shield connector 10 includes shield terminals 20 and a connector housing 60 for accommodating the shield terminals 20. The shield terminal 20 includes an inner conductor terminal 21, an outer conductor terminal 22 surrounding the outer periphery of the inner conductor terminal 21 and a dielectric 23 interposed between the outer conductor terminal 22 and the inner conductor terminal 21.

The inner conductor terminal 21 is formed, such as by bending a conductive metal plate. As shown in FIG. 4, the inner conductor terminal 21 includes a hollow cylindrical inner conductor body 24 arranged such that an axis extends in the front-rear direction. A tab 25 projects forward of the inner conductor body 24 and one inner conductor connecting piece 26 projects rearward of the inner conductor terminal 21.

The tab 25 is connected electrically to a mating terminal fitting in an unillustrated mating connector when the shield connector 10 is connected to the mating connector. The inner conductor connecting piece 26 is a strip of constant width, bent into a substantially L shape in a side view and composed of a vertical portion 27 extending down from a rear of the inner conductor body 24 and a conductor connecting portion 28 extending rearward from the lower end of the vertical portion 27. The conductor connecting portion 28 extends slightly obliquely down toward the rear and is connected electrically for signal transmission to a conductive land 91 formed on a surface of a printed circuit board 90.

The dielectric 23 is formed of an insulating synthetic resin having a predetermined dielectric constant and has a terminal accommodation chamber 29 penetrating in the front-rear direction. The inner conductor body 24 is accommodated into the terminal accommodation chamber 29. The tab 25 of the inner conductor terminal 21 projects forward from a front end opening of the terminal accommodation chamber 29 with the inner conductor body 24 held in the dielectric 23, and the conductor connecting portion 28 is exposed from a rear end opening of the terminal accommodation chamber 29. The dielectric 23 holds a clearance between the inner conductor terminal 21 and the outer conductor terminal 22 in an insulated state.

Figure 5:
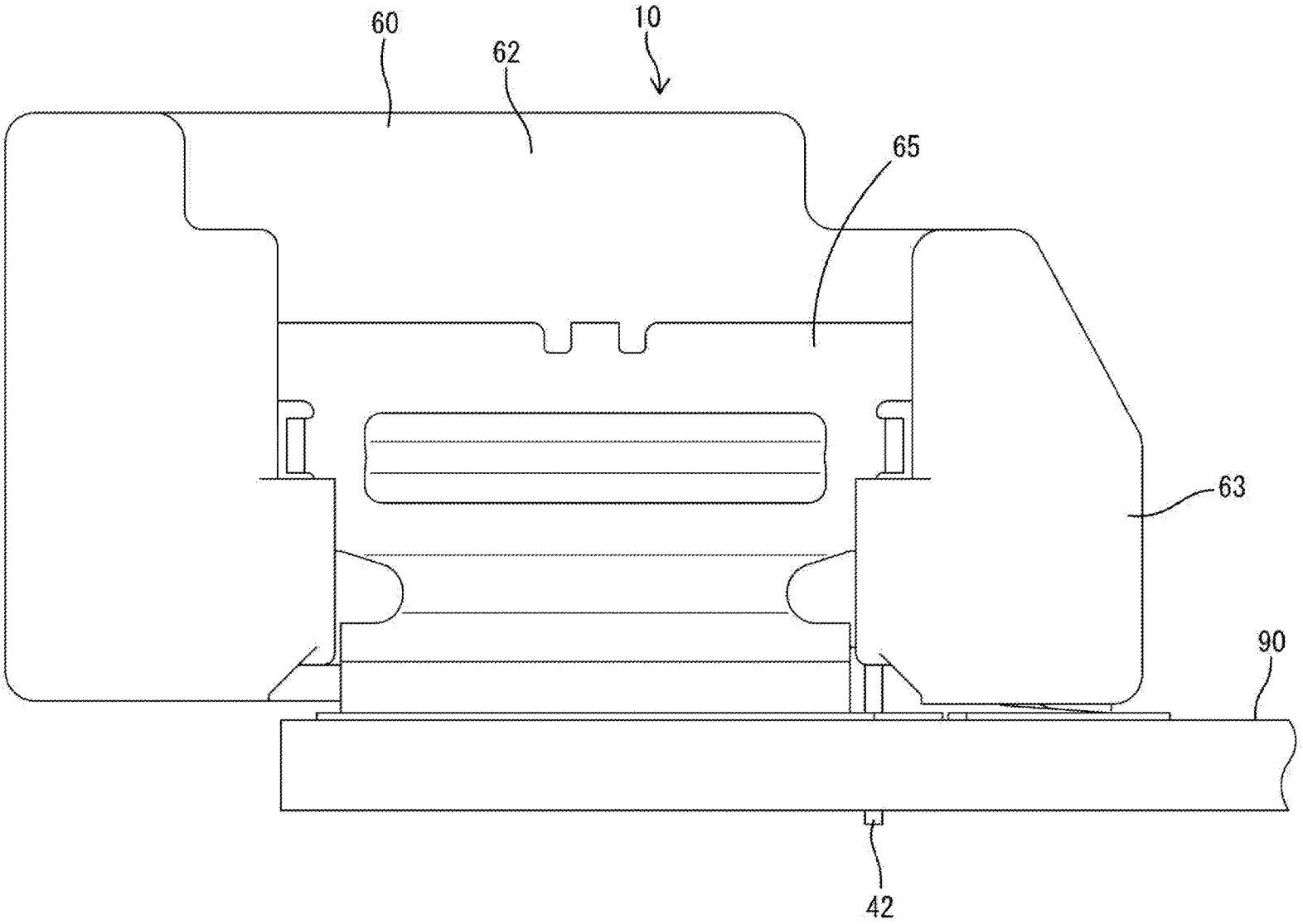
FIG. 5 is a side view of the shield connector.

The connector housing 60 is made of synthetic resin and includes, as shown in FIGS. 1 and 4, a base wall 61 along a lateral direction (width direction) and the vertical direction and a receptacle 62 in the form of a wide rectangular tube projecting forward from the outer periphery of the base wall 61. The connector housing 60 includes two side walls 63 (only one is shown in FIGS. 4 and 5) projecting rearward from both left and right ends of the base wall 61. Two fixing members 65 are mounted on parts of both left and right outer side surfaces of the connector housing 60 straddling over the receptacle 62 and the side walls 63. The fixing members 65 are L-shaped metal plates with vertical parts mounted on the connector housing 60 and lateral parts fixed to the circuit board 90 by soldering.

As shown in FIGS. 1 and 4, the receptacle 62 includes a housing lock 66 on the inner surface of an upper wall. The unillustrated mating connector is fit into the receptacle 62, and the housing lock 66 locks the mating connector to hold the connectors in a connected state.

Mounting holes 67 penetrate the base wall 61 in the front-rear direction (thickness direction of the base wall 61). As shown in FIG. 1, each mounting hole 67 has a substantially circular cross-section and four mounting holes 67 are arranged side by side while being spaced apart in the lateral direction. The outer conductor terminals 22 are inserted into the mounting holes 67.

As shown in FIG. 4, the base wall 61 includes a recess 68 in a lower surface facing the circuit board 90. The recess 68 is formed by cutting a lower corner part of the base wall 61 to have a substantially L-shaped cross-section, and is open in the lower surface, the rear surface and both side surfaces of the base wall 61. The inner upper surface of the recess 68 serves as a retracted surface 69 located farther from the surface of the circuit board 90 than the lower surface of the receptacle 62. The connector housing 60 may curve and deform in the width direction under a heating environment when reflow soldering is performed. However, the recess 68 suppresses the curved deformation and ensures planarity. Further, the recess 68 causes the retracted surface 69 to be located above a later-described third ground portion 94 provided on the circuit board 90, and is arranged to face solder paste formed on the third ground portion 94 from above without touching the solder paste. Thus, the melted solder paste does not contact the connector housing 60 and mounting reliability on the circuit board 90 is improved.

Figure 6:
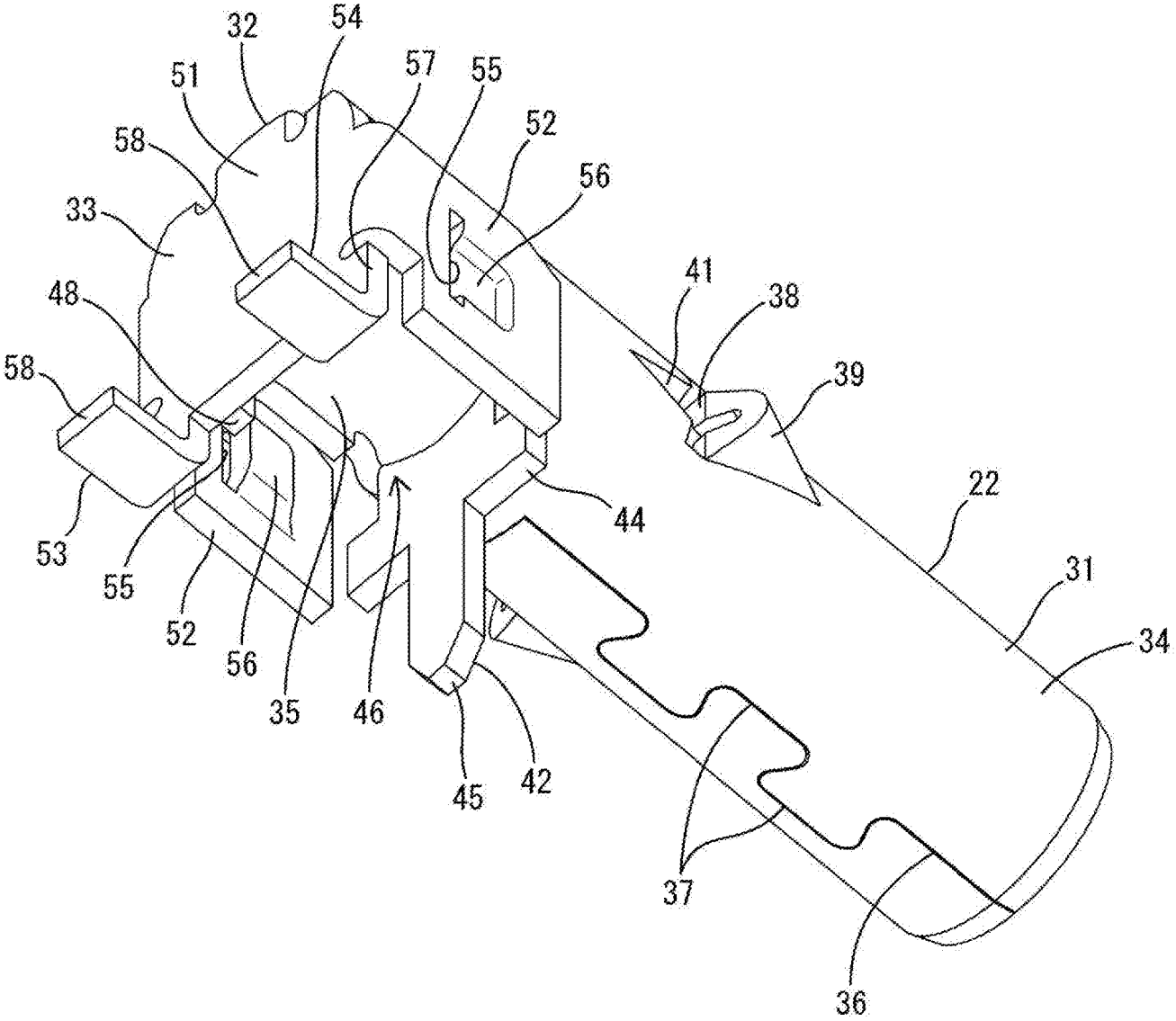
FIG. 6 is a perspective view of an outer conductor terminal viewed from below.
Figure 8:
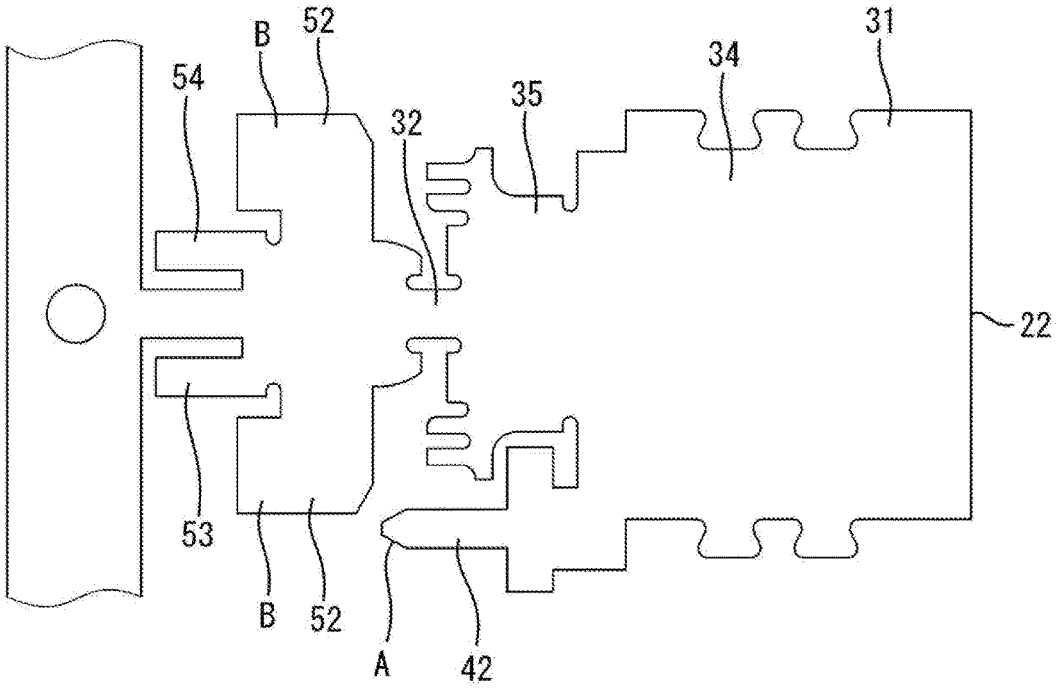
FIG. 8 is a development of the outer conductor terminal.

The outer conductor terminal 22 is formed by applying bending and the like to a conductive metal plate stamped into a developed shape shown in FIG. 8. As shown in FIGS. 4 and 6, the outer conductor terminal 22 includes a tubular outer conductor body 31 having an axis extending along the front-rear direction and a lid 33 in the form of a flat plate openably and closably coupled to the rear end of the outer conductor body 31 via a hinge 32.

As shown in FIG. 6, the outer conductor body 31 includes a hollow cylindrical tubular portion 34 and an arcuate coupling 35 connected to a rear upper part of the tubular portion 34 to be continuous with an upper part of the outer conductor body 31 without a step.

The tubular portion 34 includes butting ends 36 in a lateral center of a lower part. As shown in FIG. 6, projections and recesses 37 are provided side by side in the front-rear direction on the butting ends 36 of the tubular portion 34. The tubular portion 34 is maintained in the hollow cylindrical shape by the engagement of the projections and the recesses 37.

The tubular portion 34 includes two body-side slits 38 (only one is shown in FIG. 6) having a linear opening along the vertical direction in vertical centers of both left and right sides. Outer locks 39 to be locked to the connector housing 60 are on front sides of the body-side slits 38, and inner locks 41 to be locked to the dielectric 23 are on the rear side. Each outer lock 39 is formed by bending and raising a side wall part of the tubular portion 34 outward via the body-side slit 38 and is a substantially triangular claw in a side view. As shown in FIG. 1, the outer conductor terminal 22 is retained in the connector housing 60 by the outer locks 39 locking the inner surface of the mounting hole 67 with the outer conductor body 31 passed through the mounting hole 67. With the outer conductor terminal 22 held in the connector housing 60, a front part of the tubular portion 34 projects into the receptacle 62 and a rear part of the outer conductor body 31 and the lid 33 are exposed rearward of the base wall 61, as shown in FIG. 4. The rear part of the outer conductor body 31 and the lid 33 are protected by having both left and right sides covered by the side walls 63.

The inner locks 41 are formed by bending and raising side walls of the tubular portion 34 inward via the body-side slits 38 (see FIG. 7), and are in the form of claws substantially triangular in a side view. The dielectric 23 is inserted into the tubular portion 34 and locked by the inner locks 41 to be retained in the tubular portion 34.

Figure 7:
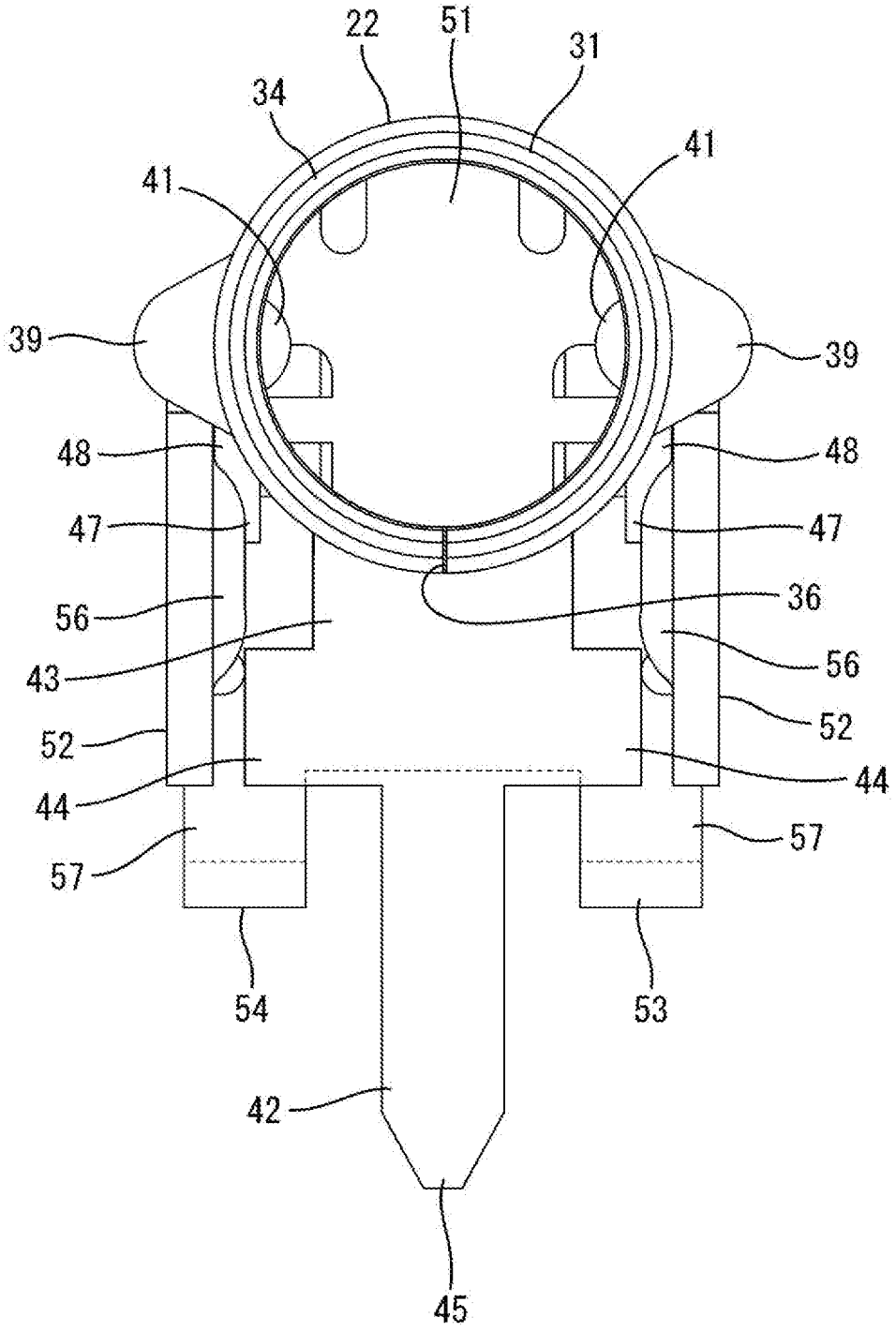
FIG. 7 is a front view of the outer conductor terminal.

As shown in FIG. 6, the tubular portion 34 includes a tab-like third outer conductor connecting piece 42 projecting down in a laterally central part of the lower end slightly behind a center in the front-rear direction. The third outer conductor connecting piece 42 is formed by downwardly bending a tab-like tongue (see part A of FIG. 8) extending rearward in the developed shape. The third outer conductor connecting piece 42 extends vertically and, as shown in FIG. 7, includes a laterally wide base 43 connected to the tubular portion 34, two protruding portions 44 protruding toward both left and right sides from the base 43, and a tab 45 narrower than the base 43 and extending down from a laterally central part of the base 43. As shown in FIG. 4, the tab 45 of the third outer conductor connecting piece 42 is inserted into a connection hole 95 of the circuit board 90 and is connected electrically to the third ground 94 formed on the circuit board 90.

The outer conductor body 31 includes a pull-out opening 46 (see FIGS. 4 and 6) that is behind the tubular portion 34 and below the coupling 35 and through which the inner conductor connecting piece 26 is pulled out toward the circuit board 90. The third outer conductor connecting piece 42 is arranged so that a rear surface, which is a plate surface outside the bend, faces the pull-out opening 46.

The coupling 35 includes two body-side locks 47 projecting downward on lower parts of both left and right sides (both circumferential end parts), as shown in FIG. 7.

Each of the body-side locks 47 includes a plate-like side plate 48 arranged such that plate surfaces thereof extend along the front-rear direction, and contacts 49 (see FIG. 4) connected behind the side plate 48. The front end of the side plate 48 can be locked into contact with a lid-side lock 56 of the lid 33 to be described later (see FIG. 6).

The contacts 49 are pin-like parts having a substantially rectangular cross-section and are connected at two positions spaced apart in the vertical direction on a plate thickness part on the rear end of the side plate 48, and formed by being bent inwardly in a plate thickness direction toward the pull-out opening 46 (see FIG. 4).

The hinge 32 is a narrow flexible link between the coupling 35 and the lid 33. The lid 33 is rotationally displaceable between an open state where the hinge 32 extends straight to open a rear side of the pull-out opening 46 and a closed state where the hinge 32 is curved and bent to close the rear side of the pull-out opening 46. As shown in FIG. 6, the lid 33 includes a back plate 51 serving as a rear surface, two sides 52 serving as side surfaces, and a first and second outer conductor connecting pieces 53 and 54 connected to the back plate 51.

The back plate 51 has a rectangular shape in a back view and, as shown in FIG. 4, is arranged along the vertical direction in the closed state to close an opening in the rear surface of the outer conductor body 31.

The two sides 52 are formed respectively by forwardly bending plate-like parts (see parts B of FIG. 8) laterally protruding from both left and right ends of the back plate portion 51, and are arranged in the closed state so that the plate surfaces extend along the front-rear direction and cover the corresponding body-side locks 47 from outside (see FIG. 7).

As shown in FIG. 6, each side 52 includes a linear (straight) lid-side slit 55 along the vertical direction in the closed state in a substantially central part and a lid-side lock 56 on a front side. The lid-side lock 56 is bent and raised inwardly toward the pull-out opening 46 in the closed state via the lid-side slit 55 and is in the form of a flat base (see FIG. 7) having a rectangular shape in a side view, and a plate thickness part of a rear end facing the lid-side slit 55 is arranged along the vertical direction. The body-side locks 47 are sandwiched between both left and right end parts of the front surface of the back plate 51 and the lid-side locks 56, and the back plate 51 contacts the respective contacts 49 of the body-side locks 47.

The first and second outer conductor connecting pieces 53, 54 have the same shape and project down from the back plate 51. As shown in FIG. 6, the first and second outer conductor connecting pieces 53, 54 are strips continuous while having the same width over the entire lengths, and have substantially L shapes in a side view. The first and second outer conductor connecting pieces 53, 54 include hanging portions 57 extending down from both left and right sides of the lower end of the back plate 51 in the closed state, and ground connecting portions 58 are bent to extend rearward from lower ends of the hanging portions 57. Each hanging portion 57 is arranged such that a front plate surface faces the pull-out opening 46. As shown in FIG. 4, the first and second outer conductor connecting pieces 53, 54 are connected electrically to the respective first and second grounds 92, 93 formed on the surface of the circuit board 90 by having the ground connecting portions 58 arranged along the surface of the circuit board 90.

Next, functions of this embodiment are described.

First, the outer conductor terminals 22 are inserted into the mounting holes 67 of the base wall 61 of the connector housing 60. In this embodiment, four outer conductor terminals 22 are mounted into the corresponding mounting holes 67 (see FIG. 1). Here, the lids 33 are in the open state and the respective contacts 49 are in a straight state before being bent.

Subsequently, the dielectrics 23 are inserted into the outer conductor terminals 22 from behind, and then the inner conductor terminals 21 are inserted into the terminal accommodation chambers 29 of the dielectrics 23. Thereafter, the respective contacts 49 are bent and the lids 33 are turned to the closed state via the hinges 32. In the process of displacing the lid 33 to the closed state, the lid-side locks 56 of the sides 52 interfere with the corresponding body-side locks 47 and the sides 52 are expanded and resiliently deformed with parts coupled to the back plate 51 as fulcrums.

When the lid 33 reaches the closed state, the back plate 51 closed the opening in the rear surface of the outer conductor body 31, the lid-side locks 56 of the sides 52 ride over the body-side locks 47, and the sides 52 resiliently return to cover the corresponding body-side locks 47 from outside. Further, when the lid 33 reaches the closed state, front lower parts of the side plates 48 enter upper parts of the lid-side slits 55 of the sides 52 (see FIG. 6), and the rear ends of the lid-side locks 56 contact the front ends of the side plates 48 along the vertical direction. Simultaneously, the back plate 51 contacts tips of the upper and lower contacts 49 along the lateral direction. Thus, the plate surface of each contact 49 outside the bend contacts along the front surface of the back plate 51 with each contact 49 slightly resiliently deformed with a base end thereof connected to the side plate 48 as a fulcrum. In this way, the lid 33 is held reliably in the closed state with respect to the outer conductor body 31.

Thereafter, the shield connector 10 is placed on the surface of the circuit board 90, and reflow soldering is applied to fix the shield connector 10 to the circuit board 90 via the fixing members 65. Further, the conductor connecting portion 28 of the inner conductor connecting piece 26 is connected to the conductive portion 91 of the circuit board 90 by reflow soldering, the tab 45 of the third outer conductor connecting piece 42 is inserted into the connection hole 95 of the circuit board 90 and connected to the third ground 94, and the ground connecting portions 58 of the first and second outer conductor connecting pieces 53, 54 are connected to the first and second ground portions 92, 93.

An electrical signal flowing in the inner conductor terminal 21 flows to the conductive portion 91 of the circuit board 90 via the inner conductor connecting piece 26. A return current corresponding to the electrical signal is generated in the outer conductor terminal 22. The return current flows along the inner surface of the outer conductor terminal 22 and is dropped to the first to third ground portions 92 to 94 of the circuit board 90 via the first to third outer conductor connecting pieces 42, 53 and 54.

Figure 2:
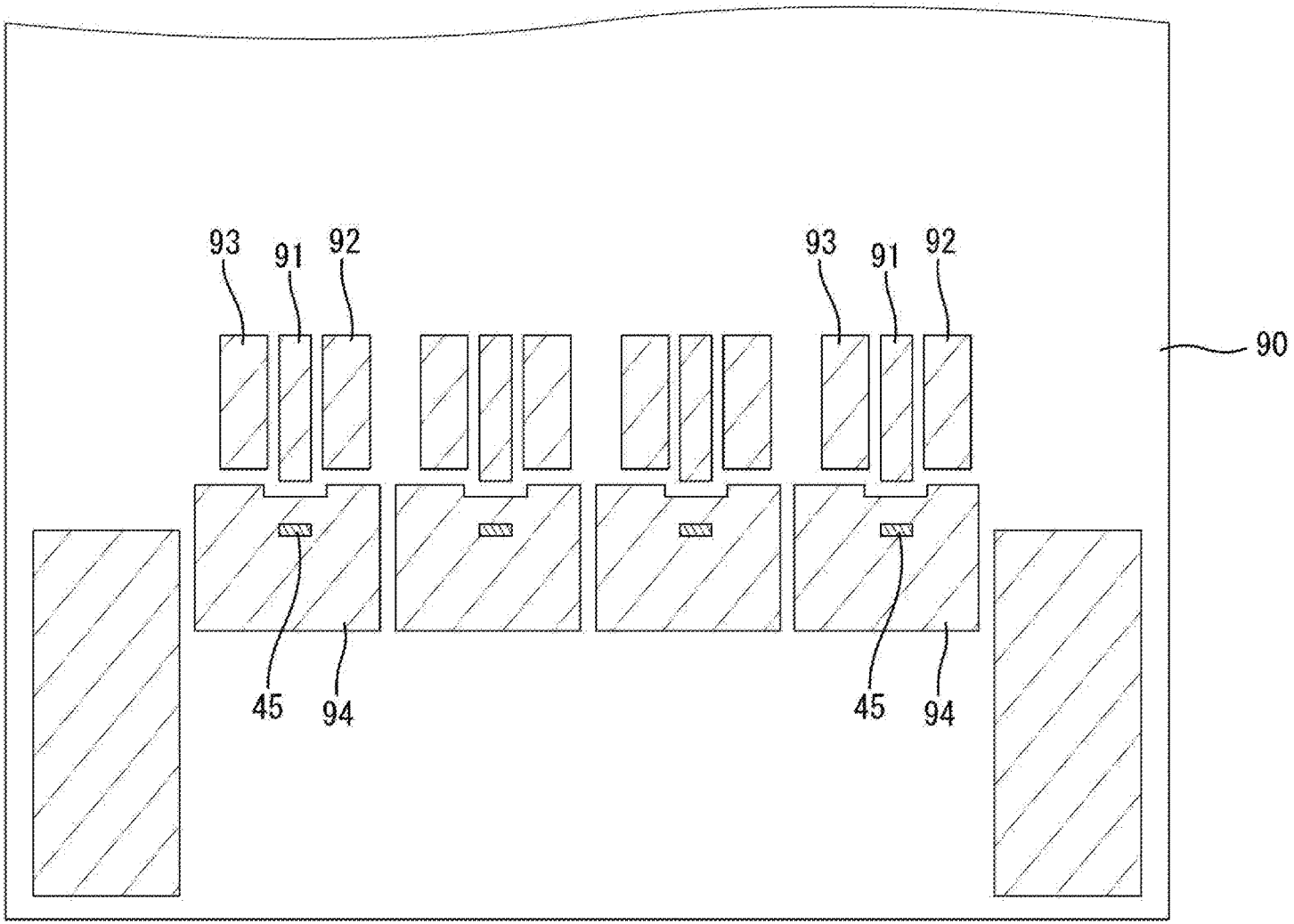
FIG. 2 is a section along X-X of FIG. 1.

The conductor connecting portion 28 of the inner conductor connecting piece 26 is pulled out rearward through a clearance open between the lower end of the back plate 51 and the circuit board 90 and between the hanging portions 57 of the first and second outer conductor connecting pieces 53, 54. As shown in FIG. 2, the first and second grounds 92, 93 are arranged in proximity to the conductive portion 91 on both left and right sides across the conductive portion 91 and respectively have a wider and larger land area than the conductive portion 91 in a plan view of the circuit board 90. The third ground 94 is in front of and in proximity to the first and second ground portions 92, 93 and the conductive portion 91 and has a wider and larger land area than a collective area of the first and second grounds 92, 93 and the conductive portion 91.

Figure 3:
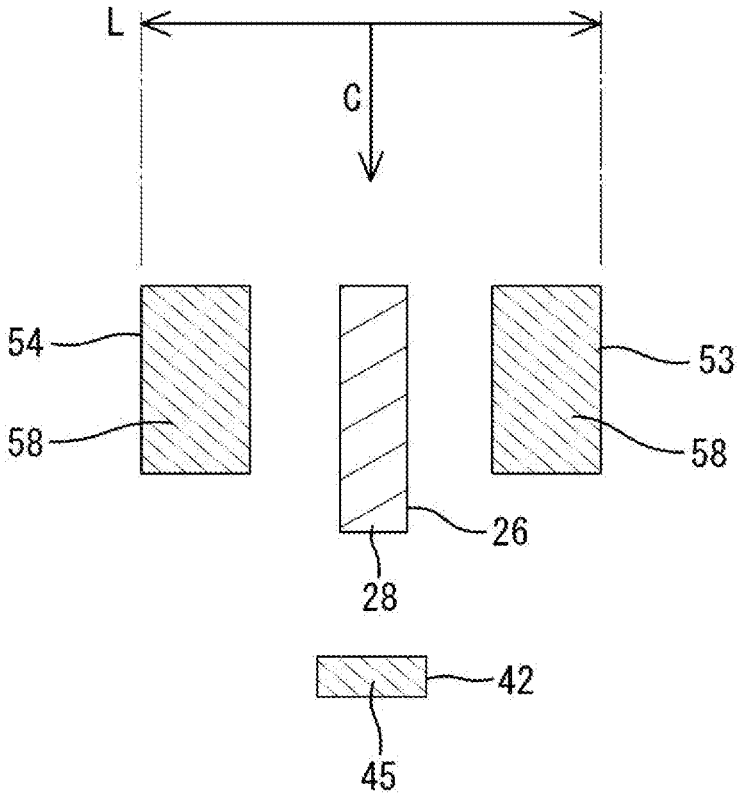
FIG. 3 is a plan view in section showing a positional relationship of first to third outer conductor connecting pieces.

As shown in FIG. 3, the ground connecting portions 58 of the first and second outer conductor connecting pieces 53, 54 are paired on both left and right sides across the conductor connecting portion 28 of the inner conductor connecting piece 26 and are in proximity to the conductor connecting portion 28 and are wider than the conductor connecting portion 28 in a plan view. The tab 45 of the third outer conductor connecting piece 42 is in front of and in proximity to the conductor connecting portion 28 of the inner conductor connecting piece 26 and is wider than the conductor connecting portion 28 by causing the plate surface (rear surface) to face the conductor connecting portion 28. Specifically, the tab 45 of the third outer conductor connecting piece 42 is near the rear surface facing the inner conductor connecting piece 26 in the C direction of FIG. 3 on an axis passing through the inner conductor connecting piece 26 and orthogonal to an arrangement direction (width direction, lateral direction, L direction of FIG. 3) of the ground connecting portions 58 of the first and second outer conductor connecting pieces 53, 54 across the conductor connecting portion 28 of the inner conductor connecting piece 26. If the ground connecting portions 58 of the first and second outer conductor connecting pieces 53, 54 and the tab 45 of the third outer conductor connecting piece 42 are connected with lines, an equilateral triangular shape or isosceles triangular shape, is formed, and the inner conductor connecting piece 26 is located inside.

In this embodiment, the outer conductor body 31 of the outer conductor terminal 22 is not at a position to cover a front side of the lower end part of the inner conductor connecting piece 26, and the back plate 51 thereof is not at a position to cover a rear side of the lower end part of the inner conductor connecting piece 26. However, as described above, the first and second outer conductor connecting pieces 53, 54 are near both left and right sides of the inner conductor connecting piece 26, and the third outer conductor connecting piece 42 is arranged on the axis passing through the inner conductor connecting piece 26 with the rear surface thereof facing the inner conductor terminal 21. Thus, the inner conductor connecting piece 26 is shielded effectively by the first to third outer conductor connecting pieces surrounding the inner conductor connecting piece 26. As a result, the shielding property by the outer conductor terminal 22 is ensured by the first to third outer conductor connecting pieces 42, 53 and 54.

According to this embodiment, the first to third outer conductor connecting pieces 42, 53 and 54 are arranged in a well-balanced manner to surround the inner conductor connecting piece 26 in a circle (virtual circle) in a plan view. The third outer conductor connecting piece 42 is grounded and connected to the third ground portion 94 substantially through a shortest path.

Specifically, the first to third outer conductor connecting pieces 42, 53 and 54 are arranged to face the pull-out opening 46 and, in a plan view, the first and second outer conductor connecting pieces 53, 54 are on both sides across the inner conductor connecting piece 26 and the third outer conductor connecting piece 42 faces the inner conductor connecting piece 26 in the axial direction (C direction of FIG. 3) orthogonal to the arrangement direction (L direction of FIG. 3) of the first and second outer conductor connecting pieces 53, 54 and passing through the inner conductor connecting piece 26. Thus, the first to third outer conductor connecting pieces 42, 53 and 54 can be positioned near the inner conductor connecting piece 26 to improve shielding.

The opening shape of the pull-out opening 46 is formed by bending the third outer conductor connecting piece 42 toward the circuit board 90. The third outer conductor connecting piece 42 is formed together with the pull-out opening 46 in a high yield by bending after stamping the metal plate. In addition, the third outer conductor connecting piece 42 is arranged with the plate surface outside the bend facing the inner conductor connecting piece 26. Thus, the third outer conductor connecting piece 42 satisfactorily shields the inner conductor connecting piece 26.

Furthermore, since the third outer conductor connecting piece 42 projects from a substantially central part (central region excluding outer end parts of the outer conductor terminal 22) of the lower end of the outer conductor body 31 in the front-rear direction and the width direction and is mounted through the connection hole 95 of the circuit board 90, even if stress that will deform the connector housing 60 acts on the outer conductor terminal 22 under a heating environment, such as during reflow soldering, that stress can escape to the circuit board 90 via the third outer conductor connecting piece 42 and a positional deviation of the outer conductor terminal 22 with respect to the circuit board 90 can be prevented.

Other embodiments are briefly described below.

The outer conductor terminal may not include the hinge and the lid and the outer conductor body may be configured as dividable separate bodies.

The outer conductor terminal may include an additional outer conductor connecting piece at a position to surround the inner conductor connecting piece in addition to the first to third outer conductor connecting pieces.

The third outer conductor connecting piece need not necessarily be arranged at the position on the axis passing through the inner conductor connecting piece to be at the same position as the inner conductor connecting piece in the width direction (arrangement direction of the first and second outer conductor connecting pieces) and may be arranged at a position between the first and second outer conductor connecting pieces (within a range defined by arrows L of FIG. 3) in the width direction (arrangement direction of the first and second outer conductor connecting pieces).

The first and second outer conductor connecting pieces may be arranged at positions deviated in the front-rear direction with respect to the inner conductor connecting piece on both left and right sides across the inner conductor connecting piece.

The first and second outer conductor connecting pieces may be shaped differently from each other.

The inner conductor connecting piece may be of a through hole mount type to be inserted into a connection hole of the circuit board.

The first and second outer conductor connecting pieces may be of a through hole mount type to be inserted into connection holes of the circuit board.

The third outer conductor connecting piece may be of a surface mount type by having a part to be arranged along the surface of the circuit board.

LIST OF REFERENCE SIGNS

10 . . . shield connector
20 . . . shield terminal
21 . . . inner conductor terminal
22 . . . outer conductor terminal
23 . . . dielectric
26 . . . inner conductor connecting piece
42 . . . third outer conductor connecting piece
46 . . . pull-out opening
53 . . . first outer conductor connecting piece
54 . . . second outer conductor connecting piece
60 . . . connector housing
68 . . . recess
90 . . . circuit board
91 . . . conductive portion
95 . . . connection hole

What is claimed is:

1. A shield terminal, comprising:

an inner conductor terminal including an inner conductor connecting piece bent to be connected to a conductive portion on a surface of a circuit board; and an outer conductor terminal including outer conductor connecting pieces bent to be connected to a ground portion on the surface of the circuit board, the outer conductor terminal surrounding the inner conductor terminal, wherein:

the outer conductor terminal is provided with a pull-out opening through which the inner conductor connecting piece is pulled out toward the circuit board, and the outer conductor connecting pieces are arranged to face the pull-out opening and include first and second outer conductor connecting pieces aligned with one another in a lateral direction and located on both sides of the inner conductor connecting piece so that the inner conductor connecting piece is located between the first and second outer conductor connecting pieces and aligned at least partly with the first and second outer conductor connecting pieces in the lateral direction, and a third outer conductor connecting piece located to face and align with the inner conductor connecting piece in a direction orthogonal to the lateral direction.

2. The shield terminal of claim 1, wherein an opening shape of the pull-out opening is formed by bending the third outer conductor connecting piece toward the circuit board, and the third outer conductor connecting piece is arranged with a plate surface outside bend facing the inner conductor connecting piece.

3. The shield terminal of claim 2, wherein the third outer conductor connecting piece projects from a central region excluding outer end parts of the outer conductor terminal and is mounted through a connection hole of the circuit board.

4. The shield terminal of claim 1, wherein the third outer conductor connecting piece of the shield terminal has a width in the lateral direction that is wider than a width of the inner conductor connecting piece of the shield terminal in the lateral direction.

5. The shield terminal of claim 1, wherein the third outer conductor connecting piece of the shield terminal has a tab that is mounted through a connection hole of the circuit board, the tab having a width in the lateral direction that is wider than a width of the inner conductor connecting piece of the shield terminal in the lateral direction.

6. The shield terminal of claim 5, wherein the third outer conductor connecting piece of the shield terminal further has first and second protruding portions above the tab, the protruding portions defining a width in the lateral direction that is wider than a width of the tab.

7. The shield terminal of claim 6, wherein ends of the first and second protruding portions align respectively with parts the first and second outer conductor connecting pieces in the direction orthogonal to the lateral direction.

8. A shield connector, comprising:

a connector housing made of a synthetic resin and having a base wall with opposite front and rear ends, mounting holes penetrating the base wall in a front-rear direction, the connector housing being mountable on a circuit board;

shield terminals mounted respectively in the mounting holes of the connector housing, each of the shield terminals includes a dielectric, an inner conductor terminal mounted in the dielectric and an outer conductor terminal surrounding at least part of the dielectric, the inner conductor terminal of each of the shield terminals including an inner conductor connecting piece bent to be connected to a conductive portion on a surface of a circuit board, and the outer conductor terminal of each of the shield terminals including outer conductor connecting pieces bent to be connected to a ground portion on the surface of the circuit board, wherein:

the outer conductor terminal of each of the shield terminals is provided with a pull-out opening through which the inner conductor connecting piece is pulled out toward the circuit board, and the outer conductor connecting pieces of each of the shield terminals are arranged to face the pull-out opening and include first and second outer conductor connecting pieces aligned with one another in a lateral direction and located on both sides of the inner conductor connecting piece so that the inner conductor connecting piece is located between the first and second outer conductor connecting pieces and aligned at least partly with the first and second outer conductor connecting pieces in the lateral direction, and a third outer conductor connecting piece located to face and align with the inner conductor connecting piece of the respective shield terminal in a direction orthogonal to the lateral direction.

9. The shield connector of claim 8, wherein the connector housing includes a recess recessed in a direction retracted from a position where the third outer conductor connecting piece is connected to the ground portion of the circuit board.

10. The shield connector of claim 8, wherein the first and second outer conductor connecting pieces of the shield terminals are aligned with one another in the arrangement direction.

11. The shield connector of claim 10, wherein the third outer conductor connecting pieces of the shield terminals are aligned with one another in the arrangement direction.

12. The shield connector of claim 8, wherein the inner conductor connecting piece of each of the shield terminals is bent to extend substantially parallel to the front-rear direction and is disposed to be connected to a conductive portion on a surface of the circuit board.

13. The shield connector of claim 12, wherein the first and second outer conductor connecting pieces of each of the shield terminals are bent to extend substantially parallel to the front-rear direction.

14. The shield connector of claim 13, wherein ends of the first and second outer conductor connecting pieces of each of the shield terminals farthest from the base wall and an end of the inner conductor connecting piece of each of the shield terminals farthest from the base wall are aligned with one another in the lateral direction.

15. The shield connector of claim 8, wherein each of the third outer conductor connecting pieces of the shield terminals has a width in the lateral direction that is wider than a width of the inner conductor connecting piece of the respective shield terminal in the lateral direction.

* * * * *